United States Patent [19]

Vermeersch et al.

[11] Patent Number: 4,879,209

[45] Date of Patent: Nov. 7, 1989

[54] PHOTOGRAPHIC PROTEINACEOUS LAYERS COMPRISING DEXTRAN DERIVATIVES

[75] Inventors: Joan T. Vermeersch, Deinze; Daniël Timmerman; Hubert Vandenabeele, both of Mortsel; Jacques L. Vervecken, Berchem, all of Belgium

[73] Assignee: AGFA-GEVAERT, N.V., Mortsel, Belgium

[21] Appl. No.: 133,080

[22] Filed: Dec. 15, 1987

[30] Foreign Application Priority Data

Dec. 23, 1986 [EP] European Pat. Off. ..... 86202376.9

[51] Int. Cl.[4] ..... G03C 1/30

[52] U.S. Cl. ..... 430/623; 430/621; 430/627; 430/639; 430/640

[58] Field of Search ..... 430/621, 627, 639, 640, 430/539, 623

[56] References Cited

U.S. PATENT DOCUMENTS

| | | | |
|---|---|---|---|
| 3,058,827 | 10/1962 | Graham | 430/621 |
| 3,382,077 | 5/1968 | Himmelmann et al. | 430/628 |
| 3,441,412 | 4/1969 | Himmelmann et al. | 430/640 |
| 3,533,800 | 10/1970 | King et al. | 430/623 |
| 4,323,644 | 4/1982 | Nakamura et al. | 430/623 |

FOREIGN PATENT DOCUMENTS 1389548 4/1975 United Kingdom .

OTHER PUBLICATIONS

Chem. Abs. 102:132391n, "Water-Insoluble Dextrans by Grafting", *Makromol, Chem.*, 1985.

*Primary Examiner*—Paul R. Michl
*Assistant Examiner*—Mark R. Buscher
*Attorney, Agent, or Firm*—A. W. Breiner

[57] ABSTRACT

The present invention provides a method of hardening a proteinaceous layer of a photographic silver halide element by incorporating a modified dextran in said proteinaceous layer, said modified dextran being the reaction product of dextran and an alkyl haloformate, a substituted alkyl haloformate, an aryl haloformate, or a substituted aryl haloformate. The invention also provides a photographic element comprising a said reaction product in at least one proteinaceous silver halide emulsion layer and/or in another proteinaceous layer coated thereon.

12 Claims, No Drawings

PHOTOGRAPHIC PROTEINACEOUS LAYERS COMPRISING DEXTRAN DERIVATIVES

DESCRIPTION

The present invention relates to a method of hardening and/or of enhancing the resistance to abrasion in wet condition of photographic proteinaceous layers with the aid of modified dextrans and to photographic elements comprising proteinaceous layers incorporating such modified dextrans.

By resistance to abrasion in wet condition is to be understood herein the resistance to abrasion of photographic proteinaceous layers moistened by any of the commonly used aqueous liquids such as a developing bath, a fixing bath, a stabilizing bath, rinsing water, etc. In this wet condition these photographic proteinaceous layers are in swollen state and thus particularly susceptible to scratching.

It is generally known to improve the mechanical properties of photographic layers such as silver halide emulsion layers, protective layers, antistatic layers, backing layers, filter layers, etc. by hardening the proteinaceous binders thereof, in particular gelatin. Various agents have been used for hardening proteinaceous binders and other polymers. Examples are chromium salts, aldehydes, s-triazines, epoxides, aziridines, isocyanates etc. However, many of these compounds have an adverse effect on the characteristics of the photographic element comprising them. Part of them bring about an increase in fog, or a reduction of the speed or gradation. Others have an insatisfactory hardening action. Still others enter into reaction at least in part with other ingredients such as dyes and colour couplers. Another important disadvantage of proteinaceous layers treated with classical hardeners is that the resistance to abrasion of such layers is still insufficient so that these layers receive scratch markings during manipulation. In DE-A No. 2,357,252 a method been described for hardening photographic gelatin layers with reaction products of water-soluble polysaccharides and water-soluble 4,6-dichloro-s-triazines. However, in spite of enhancing the mechanical strength of photographic gelatin layers, many such agents significantly reduce the covering power of the developed silver.

Attempts have therefore been made to improve also the covering power of silver halide emulsion layers by adding various agents to the proteinaceous binder. For instance, according to U.S.-A No. 3,063,838, BE-A No. 585,486, and U.S.-A No. 3,203,804 dextran is added to silver halide gelatin emulsions to increase the covering power. However, the resistance to abrasion in wet condition of emulsion layers comprising dextran is too low so that these layers are vulnerable and can get scratched easily.

It is therefore an object of the present invention to provide a method of hardening and/or of enhancing the resistance to abrasion in wet condition of proteinaceous layers of photographic silver halide elements whilst no impairing the covering power of the silver developed therein.

It is another object of the present invention to provide a photographic element comprising in at least one proteinaceous silver halide emulsion layer and/or in another proteinaceous layer coated thereon improved hardeners, which do not have the above adverse effects.

These objects can be accomplished according to the present invention by a method of hardening a proteinaceous layer of a photographic silver halide element by incorporating a modified dextran in said proteinaceous layer, characterized in that said modified dextran is the reaction product of dextran and at least one reagent selected from the group consisting of an alkyl haloformate, a substituted alkyl haloformate, an aryl haloformate, or a substituted aryl haloformate, preferably an alkyl chloroformate, a substituted alkyl chloroformate, an aryl chloroformate, or a substituted aryl chloroformate.

The present invention also provides a photographic element comprising in at least one proteinaceous silver halide emulsion layer and/or in another proteinaceous layer coated thereon a modified dextran, characterized in that said modified dextran is a reaction product of dextran and at least one reagent selected from the group consisting of an alkyl haloformate, a substituted alkyl haloformate, an aryl haloformate, or a substituted aryl haloformate.

It has been established surprisingly that in a photographic element comprising in at least one proteinaceous silver halide emulsion layer and/or in another proteinaceous layer coated thereon the reaction product of dextran and at least one reagent selected from the group consisting of an alkyl haloformate, a substituted alkyl haloformate, an aryl haloformate, and a substituted alkyl haloformate, a better hardening and/or higher resistance to abrasion in wet condition are obtained before and after development than with common dextran alone, even though the absorption of water and the melting point of the proteinaceous layer(s) remain almost unchanged. It has also been experienced that the covering power of the silver image formed in the developed photographic element comprising a proteinaceous layer incorporating the reaction product of dextran and at least one reagent selected from the group consisting of an alkyl haloformate, a substituted alkyl haloformate, an aryl haloformate, or a substituted aryl haloformate is of substantially the same level as that obtained in an analogous photographic element comprising a proteinaceous layer incorporating common dextran. It was also found that the reaction products of dextran and at least one reagent selected from the group consisting of an alkyl haloformate, a substituted alkyl haloformate, an aryl haloformate, or a substituted aryl haloformate have no adverse effect on the photographic characteristics and that they have a reduced tencency to migrate from one layer to the other so that their influence on the mechanical characteristics of other layers is low.

The reaction products of dextran for use in accordance with the present invention can be incorporated in any proteinaceous layer e.g. a protective or antistress layer, an antistatic layer, a backing layer, a filter layer, and a silver halide emulsion layer. Of course, they can also be used for hardening other types of proteinaceous layers or compositions.

The reaction products of dextran and at least one reagent selected from the group consisting of an alkyl haloformate, a substituted alkyl haloformate, an aryl haloformate, or a substituted aryl haloformate comprise dextran moieties, at least part of which have been modified by reaction with 1, 2, or 3 alkyl haloformate, substituted alkyl haloformate, aryl haloformate, or substituted aryl haloformate molecules. The modified dextran moieties can be represented by the following general formula:

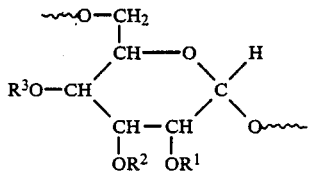

wherein:

$R^1$ represents —CO—O—R, wherein R represents an alkyl group e.g. ethyl and methyl, a substituted alkyl group e.g. hydroxymethyl, hydroxyethyl, chloromethyl, and chloroethyl, an aryl group e.g. phenyl, or a substituted aryl group e.g. hydroxyphenyl, dihydroxyphenyl, trihydroxyphenyl, methoxyphenyl, chlorophenyl, dichlorophenyl, trichlorophenyl, and pentachlorophenyl, each of $R^2$ and $R^3$, which can be same or different, represents hydrogen or has a significance as defined for $R^1$.

Suitable modified dextrans for use in accordance with the present invention are the reaction products of dextran with one or more of the following haloformates:

ethyl chloroformate
phenyl chloroformate
ethyl chloroformate and phenyl chloroformate
3-hydroxyphenyl chloroformate
3-methoxyphenyl chloroformate
2-chloroethyl chloroformate
4-chlorophenyl chloroformate.

Preference, however, is being given to the reaction product with ethyl chloroformate.

The reaction products of dextran for use in accordance with the present invention comprise reactive groups that are capable of forming covalent bonds with proteins e.g. gelatin.

The reaction products of dextran for use in accordance with the present invention can be synthesized as illustrated by the following Preparations.

PREPARATION 1

An amount of 2200 ml of formamide is brought under nitrogen atmosphere in a 5 l flask equipped with a stirrer and a reflux condenser. An amount of 600 g of dextran dried under reduced pressure at 100° C. is dissolved therein. After complete dissolution of the dextran 12 g of dimethylaminopyridine and 225 g of pyridine is added. An amount of 281 g of ethyl chloroformate is added slowly with stirring e.g. at a rate of 210 ml/h. After addition of the total amount of ethyl chloroformate the solution is stirred for two more hours at room temperature. The modified dextran is precipitated with 30 l of methanol. The precipitate is washed with methanol, dissolved in 10 l of water, and precipitated again with ethanol. The resulting precipitate of modified dextran is dried under reduced pressure.

PREPARATION 2

An amount of 2200 ml of formamide is brought under nitrogen atmosphere in a 5 l flask equipped with a stirrer and a reflux condenser. An amount of 600 g of dextran dried under reduced pressure at 100° C. is dissolved therein. After complete disolution of the dextran 8 g of dimethylaminopyridine and 225 g of pyridine is addd. An amount of 270 g of phenyl chloroformate is added slowly with stirring e.g. at a rate of 210 ml/h. After addition of the total amount of phenyl chloroformate the solution is stirred for two more hours at room temperature. The modified dextran is precipitated with 30 l of methanol. The precipitate is washed with methanol, dissolved in 10 l of water, and precipitated again with ethanol. The resulting precipitate of modified dextran is dried under reduced pressure.

PREPARATION 3

An amount of 2200 ml of formamide is brought under nitrogen atmosphere in a 5 l flask equipped with a stirrer and a reflux condenser. An amount of 600 g of dextran dried under reduced pressure at 100° C. is dissolved therein. After complete dissolution of the dextran 10 g of dimethylaminopyridine and 225 g of pyridine is added. An amount of 281 g of ethyl chloroformate and 90 g of phenyl chloroformate is added slowly with stirring e.g. at a rate of 210 ml/h. After addition of the total amount of ethyl chloroformate and phenyl chloroformate the solution is stirred for two more hours at room temperature. The modified dextran is precipitated with 30 l of methanol. The precipitate is washed with methanol, dissolved in 10 l of water, and precipitated again with ethanol. The resulting precipitate of modified dextran is dried under reduced pressure.

In the preparation of the modified dextrans the ratio by weight of dextran to alkyl or aryl haloformate may vary from about 100:2 to about 1:4, preferably from about 10:2 to about 1:1.

The modified dextrans can be added in the form of an aqueous solution to a coating composition for forming a proteinaceous layer of a photographic element according to the present invention. Other solvents can be used alone or in combination with water for dissolving the modified dextrans. Suitable solvents are water-miscible organic solvents such as methanol, ethanol, acetone, dioxan, acetonitrile, tetrahydrofuran, formamide, dimethylformamide, and dimethyl sulphoxide.

The solution of modified dextrans can also be prepared in bulk and can be stored for a fairly long time without loosing its effectiveness. A batch can be taken at any moment from the bulk and be added to an aqueous coating composition for forming a proteinaceous layer.

The proteinaceous layers of the photographic elements of the present invention comprise the reaction products of dextran and alkyl or aryl haloformate in an amount ranging from about 1 to about 60% by weight, preferably from about 3 to about 35% by weight, of the dry proteinaceous material. The modified dextrans for use according to the present invention can, of course, be added in combination with known hardeners.

The proteinaceous material that can be hardened successfully according to the method of the present invention can be any of the proteins customarily used as binder in photographic layers e.g. albumin, zein, collagen, keratin, casein. A preferred proteinaceous material is, however, gelatin.

The proteinaceous layers of the photographic elements of the present invention may comprise other ingredients such as matting agents e.g. silica, the polymr beads described in EP-A No. 0,080,225; wetting agents, antistatic agents, filter dyes, plasticizers, filling agents, and anti-Newton additives.

Suitable surface-active agents that can be added to the aqueous coating composition for forming a surface layer of the photographic elements of the present invention have been described in GB-A Nos. 1,293,189 and 1,460,894, in BE-A No. 742,680, and in U.S.-A No. 4,292,402. A survey of surface-active agents that can be added to the aqueous coating composition can be found in Gerhard Gawalek's "Wasch- and Netzmittel" Akademieverlag, Berlin (1962). Examples of suitable surface-active agents are the sodium salt of N-methyl-oleyltauride, sodium stearate, heptadecenylbenzimidazole sulphonic acid sodium salt, sodium sulphonates of higher aliphatic alcohols e.g. 2-methyl-hexanol sodium sulphonate, sodium diiso-octyl-sulphosuccinate, sodium dodecyl sulphate, tetradecyl benzene sulphonic acid sodium salt. Other interesting surface-active agents are the fluorinated surface-active agents like e.g. perfluorocaprylic acid ammonium salt.

Suitable antistatic agents that can be added to the aqueous coating composition for forming a proteinaceous layer have been described in EP-A No. 0.180,668.

The thickness of the proteinaceous layer may range from about 0.5 to about 2.5 μm, preferably from 1 to 1.5 μm.

When the proteinaceous layer is a photosensitive proteinaceous silver halide emulsion layer, the silver halide can be composed of silver bromide, silver iodide, silver chloride, or mixed silver halides e.g. silver chlorobromide, silver bromoiodide, and silver chlorobromoiodide.

When the proteinaceous layer is a photosensitive proteinaceous silver halide emulion layer, it may contain the usual emulsion additives such as e.g. stabilizers, fog-inhibitors, speed-increasing compounds, colloid hardeners, plasticizers etc. The silver halide emulsion may be spectrally sensitized or non-spectrally sensitized.

The support of photographic elements according to the present invention can be a transparent film support as well as a non-transparent support.

When the support of the photographic element for use in accordance with the present invention is a non-transparent support, it usually is a paper support, preferably paper coated on one side or on both sides with an Alpha-olefin polymer, e.g. polyethylene.

Any conventional transparent hydrophobic resin film made of a cellulose ester e.g. cellulose triacetate, a polyester e.g. polyethylene terephthalate, polyvinylacetal, and polystyrene can be used as transparent film support. These hydrophobic resin film supports are preferably coated with at least one subbing layer to improve the adherence thereto of hydrophilic colloid layers e.g. of silver halide emulsion layers. Suitable subbing layers for that purpose have been described in e.g. U.S.-A No. 3,495,984; U.S.-A No. 3,495,985; U.S.-A No. 3,434,840; U.S.-A No. 3,788,856; and GB-A No. 1,234,755.

The support of photographic elements according to the present invention can thus carry on one or on both sides thereof and in the given order: at least one subbing layer, at least one photosensitive proteinaceous silver halide emulsion layer, which may comprise the reaction product of dextran and an alkyl or aryl haloformate and/or at least one other non-photosensitive proteinaceous layer coated thereon, which may comprise a said reaction product, wherein at least one of said photosensitive or non-photosensitive proteinaceous layers comprises a said reaction product.

The photographic elements according to the present invention can be of various types e.g. X-ray photographic elements including both medical type and industrial type for non-destructive testing, photographic elements for graphic arts and for so-called amateur and professional photography, continuous tone or high contrast photographic elements, photographic motion picture elements, photographic elements including image-receiving elements for silver complex or colour diffusion transfer processes, photographic elements comprising non-spectrally sensitized emulsion or spectrally sensitized emulsions, high-speed or low-speed photographic elements, and black-and-white or colour photographic elements.

The following examples illustrate the present invention.

EXAMPLE 1

The pH-value of a 5% aqueous gelatin solution comprising 16 ml of a 4% aqueous solution of formaldehyde and 10 ml of a 5% aqueous solution of perfluorocaprylic acid ammonium salt was adjusted to 7.0 with sodium hydrogen carbonate and divided in 3 equal parts.

Sample A: a 20% aqueous solution of commercially available dextran was added to the first part in such an amount that the ratio by weight of dry gelatin to dry dextran was 3:1.

Sample B: a 20% aqueous solution of the reaction product of dextran and ethyl chloroformate, prepared as described in the Preparation 1 hereinbefore and stored in bulk for 5 days, was added to the second part in such an amount that the ratio by weight of dry gelatin to the dry reaction product of dextran and ethyl chloroformate was 3:1.

Sample C: a 20% aqueous solution of the reaction product of dextran and ethyl chloroformate, freshly prepared as described in the Preparation 1 hereinbefore, was added to the third part in such an amount that the ratio by weight of dry gelatin to the dry reaction product of dextran and ethyl chloroformate was 3:1.

Each sample was then coated at a ratio of 0.6 g per m2 on a layer of gelatin silver bromoiodide (2 mol % of iodide) medical X-ray emulsion comprising per kg of emulsion 65 g of gelatin, which emulsion layer had itself been coated on a subbed polyethylene terephthalate support at a ratio of about 23 m2 per kg of emulsion. The emulsion layer had a silver content (expressed in silver nitrate) of 5 g per m2. After a storage of 2 h at 57° C. in a relative humidity of 34% the absorption of water, the melting point, and the resistance to abrasion of each sample were determined. The absorption of water was measured gravimetrically. The resistance to abrasion of each sample, having been immersed in water at 20° C., was measured by means of a device, in which a steel ball is drawn over the swollen sample, the ball having a diameter of 3 mm. The ball can be charged with a continuously increasing weight, the resistance to abrasion corresponding to the lowest weight (expressed in gram), at which the ball starts scratching the sample visibly when viewed in transmission. The results are listed in Table 1.

TABLE 1

| | Absorption of water in g/m2 | Melting point in °C. | Resistance to abrasion in wet condition |
|---|---|---|---|
| Sample A | 11.4 | 80 | 130 |
| Sample B | 10.4 | 80 | 195 |
| Sample C | 10.4 | 90 | 190 |

These results show that the Samples B and C comprising the reaction product of dextran and ethyl chloroformate according to the present invention have a considerably higher relative to abrasion in wet condition than Sample A comprising common dextran alone, in spite of the fact that the changes in absorption of water and melting point between the 3 samples are negligible.

EXAMPLE 2

A gelatin silver bromoiodide (2 mol % of iodide) medical X-ray emulsion comprising per kg of emulsion 65 g of gelatin was coated on both sides of a subbed polyethylene terephthalate support at a ratio of about 23 m2 per kg of emulsion per side. Each of the resulting emulsion layers had a silver content (expressed in silver nitrate) of 5 g er m2.

Two identical strips D and E were cut from the resulting material and, while still wet, covered on both sides with the following aqueous coating composition, which in the case of strip D (comparison material) comprised commercially available dextran as dextran compound and in the case of strip E the reaction product of dextran and ethyl chloroformate prepared as described in the Preparation 1 hereinbefore (material according to the present invention). The aqueous coating composition comprised:

| | |
|---|---|
| gelatin | 40 g |
| dextran compound | 5 g |
| 5% aqueous solution of the ammonium salt of perfluorocaprylic acid | 10 ml |
| 5% aqueous solution of sodium diisooctyl sulphosuccinate | 18 ml |
| 4% aqueous solution of formaldehyde | 16 ml |
| water to make | 1000 ml |

Each of the gelatin surface layers was coated at a ratio of 1.1 g of gelatin per m2 and had a thickness of 1.0 μm. After having been dried and stored for 48 h at 57° C. and a relative humidity of 34%, the gelatin surface layers on strips D and E were found to have a melting point higher than 80° C.

Both resulting Elements D and E were exposed and developed in a developer at 35° C. comprising:

| | |
|---|---|
| methylaminophenol | 2.0 g |
| anhydrous sodium sulphite | 90.0 g |
| hydroquinone | 8.0 g |
| sodium carbonate monohydrate | 52.5 g |
| anhydrous potassium bromide | 5.0 g |
| water to make | 1000 ml |

The covering power of the silver image developed in Elements D and E was then measured. The covering power is the reciprocal of the photographic equivalent of developed silver, i.e. the number of grams of silver per sq. decimeter divided by the maximum optical density. The resistance to abrasion of the wet surface layers was determined as described in Example 1. The values measured are listed in Table 3.

TABLE 3

| | Resistance to abrasion in wet condition | Covering power |
|---|---|---|
| Element D (commercial dextran) | 120 | 38 |
| Element E (reaction product acc. to present invention) | 180 | 37 |

These results show that the resistance to abrasion of Element E carrying surface layers according to the preent invention was much higher than that of Element D and that the covering power of the silver image formed in the developed Element E was almost as high as that obtained in Element D comprising the commercially available dextran. It was also found that neither the reaction product of dextran and ethyl chloroformate nor the commercial dextran had any adverse influence on the photographic characteristics. Moreover the tencency of the reaction product of dextran and ethyl chloroformate of migrating from the surface layer to the emulsion layer was low.

We claim:

1. Method of hardening a proteinaceous layer of a photographic silver halide element by incorporating a modified dextran in said proteinaceous layer, wherein said modified dextran is a reaction product of dextran and at least one reagent selected from the group consisting of an alkyl haloformate, a substituted alkyl haloformate, an aryl haloformate, and a substituted aryl haloformate.

2. A method according to claim 1, wherein said alkyl haloformate, substituted alkyl haloformate, aryl haloformate, or substituted aryl haloformate is an alkyl chloroformate, a substituted alkyl chloroformate, an aryl chloroformate, or a substituted aryl chloroformate.

3. A method according to claim 1, wherein said alkyl haloformate is ethyl chloroformate.

4. A method according to claim 1, wherein in said reaction product the ratio by weight of dextran to alkyl haloformate, substituted alkyl haloformate, aryl haloformate, or substituted aryl haloformate varies from about 10:2 to about 1:1.

5. A method according to claim 1, wherein said reaction product is present in an amount ranging from about 3 to about 35% by weight, of the dry proteinaceous material.

6. A method according to claim 1, wherein said proteinaceous material is gelatin.

7. Photographic element comprising in at least one proteinaceous silver halide emulsion layer and/or in another proteinaceous layer coated thereon a modified dextran, wherein said modified dextran is a reaction product of dextran and at least one reagent selected from the group consisting of an alkyl haloformate, a substituted alkyl haloformate, an aryl haloformate, and a substituted aryl haloformate.

8. A photographic element according to claim 7, wherein said alkyl haloformate, substituted alkyl haloformate, aryl haloformate, or substituted aryl haloformate is an alkyl chloroformate, a substituted alkyl chloroformate, an aryl chloroformate, or a substituted aryl chloroformate.

9. A photographic element according to claim 7, wherein said alkyl haloformate is ethyl chloroformate.

10. A photographic element according to claim 7, wherein in said reaction product the ratio by weight of dextran to alkyl haloformate, substituted alkyl haloformate, aryl haloformate, or substituted aryl haloformate varies from about 10:2 to about 1:1.

11. A photographic element according to claim 7, wherein said reaction product is present in an amount ranging from about 3 to about 35% by weight, of the dry proteinaceous material.

12. A photographic element according to claim 7, wherein said proteinaceous material is gelatin.

* * * * *